US006105521A

United States Patent [19]

Sato

[11] Patent Number: 6,105,521

[45] Date of Patent: Aug. 22, 2000

[54] SEWING MACHINE WITH SHUTTLE REPLENISHING

[75] Inventor: Isao Sato, Gifu, Japan

[73] Assignee: Hashima Co., Ltd., Japan

[21] Appl. No.: 09/299,701

[22] Filed: Apr. 26, 1999

[51] Int. Cl.[7] ..... D05B 59/04; D05B 57/26

[52] U.S. Cl. ..... 112/186

[58] Field of Search ..... 112/180, 186, 112/194, 195, 196, 279

[56] References Cited

U.S. PATENT DOCUMENTS

| | | | |
|---|---|---|---|
| 991,173 | 5/1911 | Schoenfeld | 112/186 |
| 1,052,208 | 2/1913 | Belz | 112/186 |
| 2,609,102 | 9/1952 | Henle | 112/186 X |
| 5,400,730 | 3/1995 | Moll et al. | 112/186 |
| 5,718,181 | 2/1998 | Shinozuka et al. | 112/180 |

FOREIGN PATENT DOCUMENTS

| | | | |
|---|---|---|---|
| 2065263 | 2/1973 | Germany | 112/186 |

*Primary Examiner*—Ismael Izaguirre
*Attorney, Agent, or Firm*—D. Peter Hochberg; William H. Holt

[57] ABSTRACT

A sewing machine has needles reciprocally movable in a first direction through a fabric web and shuttles reciprocally movable in a second direction perpendicular to the first direction. The used shuttles accommodating an empty bobbin is replaced with the new shuttle accommodating a full bobbin. The needles and the shuttles cooperate to form stitch patterns on the fabric web. A device is provided for the automatic replacement of the used shuttle with the new shuttle.

17 Claims, 12 Drawing Sheets

SEWING MACHINE WITH SHUTTLE REPLENISHING

BACKGROUND OF THE INVENTION

The present invention relates to sewing machines that form stitching patterns on a fabric web by the cooperative motion of needles and shuttles.

A sewing machine such as a quilting machine has a needle plate and a plurality of needles, which are arranged above the needle plate. The needles are reciprocated vertically to pierce a fabric web and feed upper threads. A shuttle is arranged in correspondence with each needle below the needle plate. Each shuttle is reciprocated transversely relative to the associated needle. A bobbin wound with a lower thread is housed in each shuttle. The cooperative reciprocation of the needles and the shuttles forms stitching patterns on the fabric web with the upper and lower threads.

In a typical quilting machine, a lower thread having a predetermined length is wound on a bobbin. When all of the lower thread becomes used during the sewing operation, the shuttle accommodating the empty bobbin is manually removed from its sewing position and replaced with a shuttle accommodating a full bobbin. The burdensome replacement of the shuttles degrades the sewing efficiency.

The manual replacement of shuttles is especially inefficient when using a quilting machine that employs a large number of shuttles. The manual replacement of shuttles in a quilting machine consumes a large amount of time.

SUMMARY OF THE INVENTION

Accordingly, it is an objective of the present invention to provide a sewing machine that enhances sewing efficiency.

To achieve the above objective, an improved sewing machines is proposed. The sewing machine has needles reciprocally movable in a first direction through a fabric web and shuttles reciprocally movable in a second direction perpendicular to the first direction. The used shuttles accommodating an empty bobbin is replaced with the new shuttle accommodating a full bobbin. The needles and the shuttles cooperate to form stitch patterns on the fabric web. A device is provided for the automatic replacement of the used shuttle with the new shuttle.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A quilting machine according to the present invention will now be described with reference to FIGS. 1–12.

Figure 1:
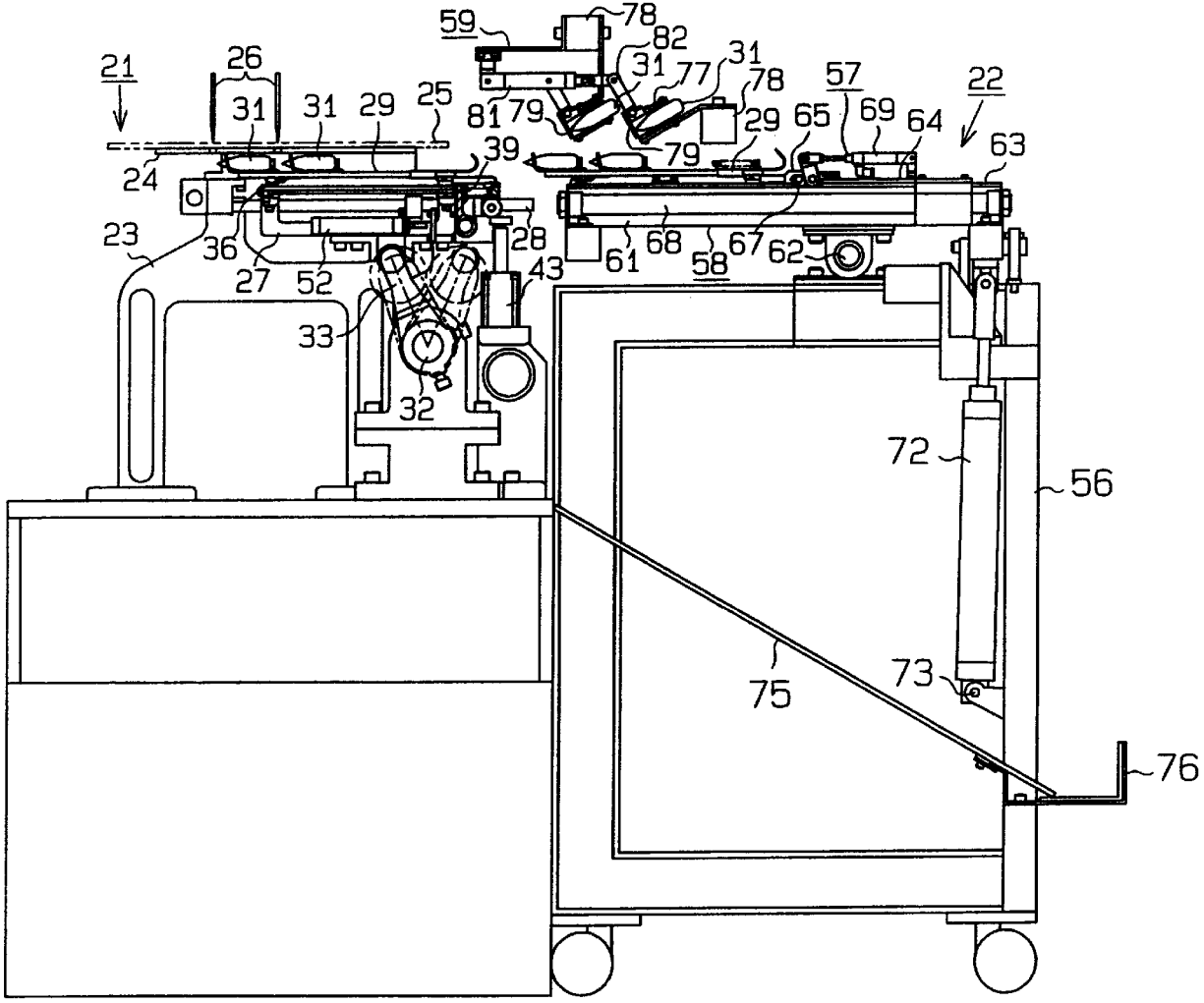
FIG. 1 is a side view showing a sewing machine according to the present invention.
Figure 2:
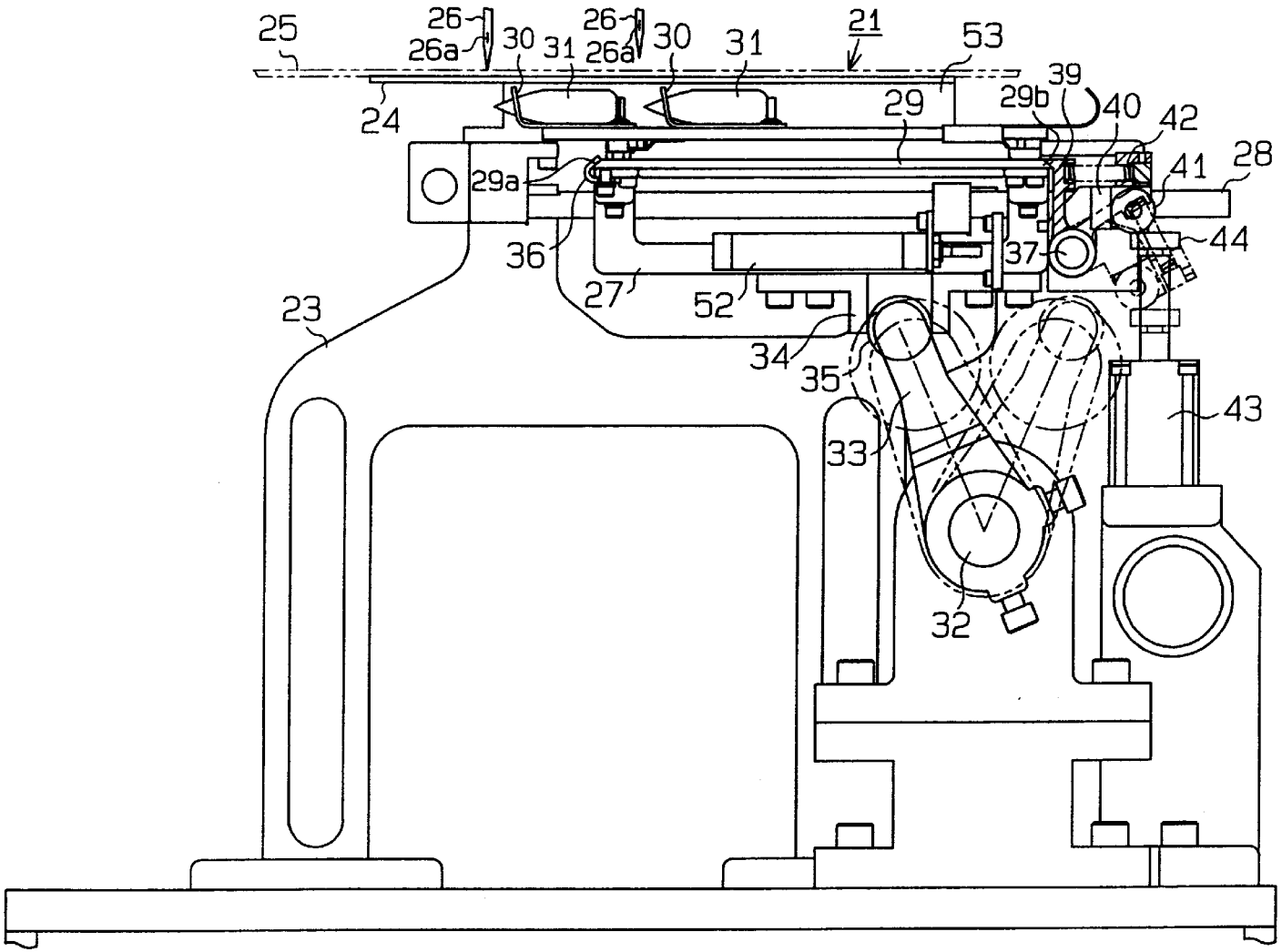
FIG. 2 is an enlarged side view showing a sewing device employed in the sewing machine of FIG. 1.

A quilting machine includes a sewing device 21 and a shuttle exchanging device 22, as shown in FIGS. 1 and 2. The sewing device 21 has a main frame 23 on which a needle plate 24 is arranged. Layered fabric webs 25 are transferred along the needle plate 24. Two rows of equally spaced needles 26 are arranged above the needle plate 24. Each needle 26 is reciprocated vertically to pierce the fabric web 25 held on the needle plate 24. Each needle has an eye 26*a* through which an upper thread is threaded. The upper thread is fed from a thread supply source (not shown).

Figure 4:
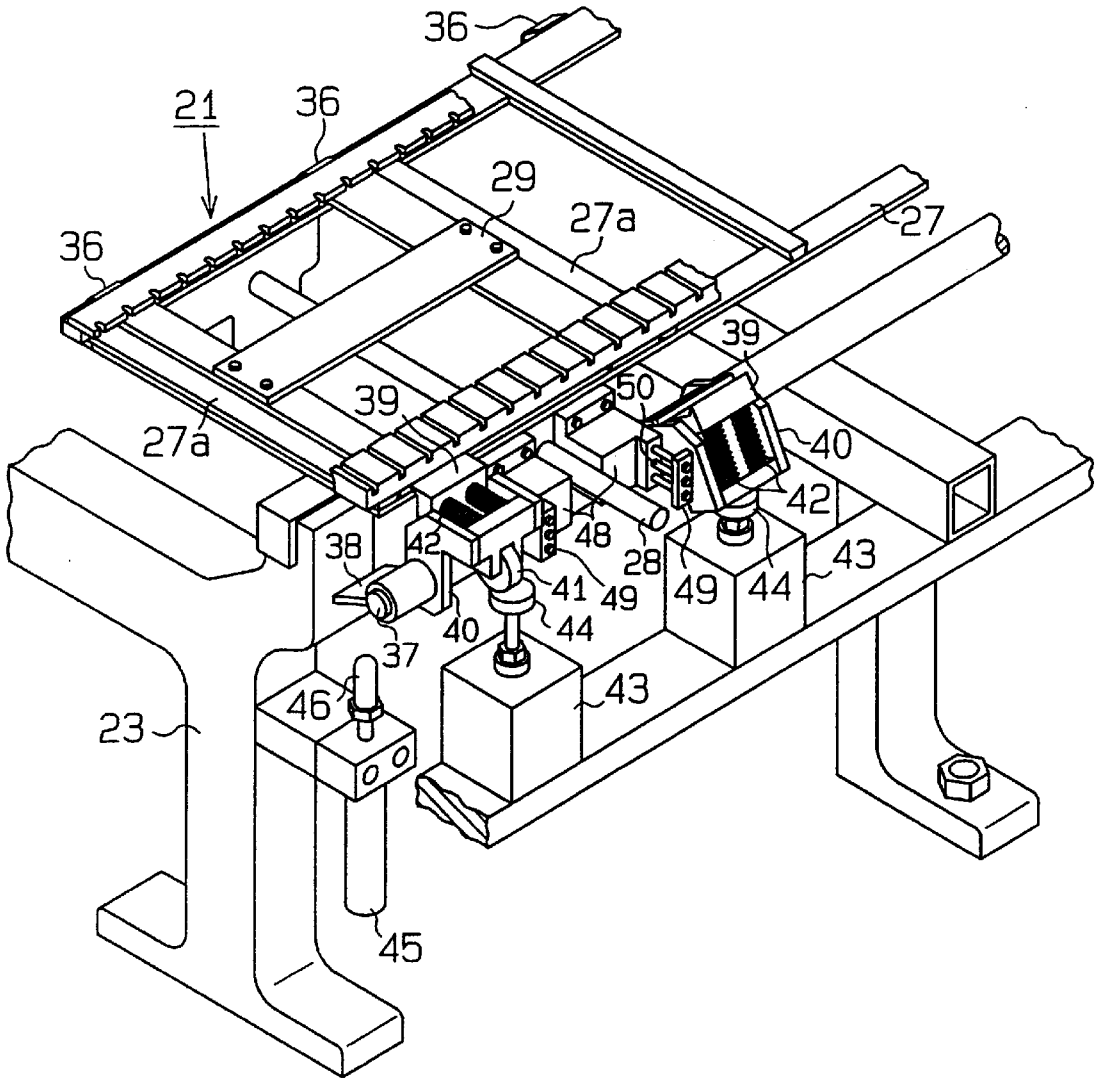
FIG. 4 is a schematic perspective view showing the sewing device.

As shown in FIGS. 1, 2, and 4, a movable platform 27 is arranged under the needle plate 24. The platform 27 is guided by guide rods 28 to move reciprocally in a direction perpendicular to the axes of the needles 26 (the direction parallel with the plane of FIG. 2). Pairs of guide rails 27*a* are arranged on the platform 27. A shuttle holder 29 is movably held on each pair of guide rails 27*a* and guided along a guide wall 53. A shuttle carrier 30 is provided on each shuttle holder 29 for each needle 26. A shuttle 31 is detachably held in each carrier 30 for each needle 26. Each shuttle 31 corresponds to one of the needles 26. A bobbin (not shown) wound with a predetermined length of the lower thread is housed in each shuttle 31.

A drive shaft 32 is rotatably supported by the main frame 23 under the movable platform 27. A lever 33 is fixed to the drive shaft 32. The lever 33 has a distal end on which a roller 35 is rotatably supported. The platform 27 includes an engaging portion 34, which engages the roller 35. When the lever 33 moves between the position shown by the solid lines and the position shown by the broken lines in FIGS. 1 and 2, the platform 27, the shuttle holders 29, and the shuttles 31 are moved in a direction perpendicular to the needles 26. The cooperative motion of the needles 26 and the shuttles 31 forms stitching patterns on the fabric web 25.

As shown in FIGS. 2 and 4, a pair of fixed stoppers 36 are fixed to the front end of the platform 27 in correspondence with each shuttle holder 29. When each shuttle holder 29 is moved away from the shuttle exchanging device 22 along the platform 27, the associated fixed stoppers 36 engages the front end 29*a* of the shuttle holder 29 and restricts further advancement of the shuttle holder 29.

A rotary shaft 37 is supported at the rear end of the platform 27. A lever 38 is fitted on each end of the rotary shaft 37. A movable stopper 39 is pivotally supported on the rotary shaft 37 in correspondence with each fixed stopper 36. A bracket 40 is provided for each movable stopper 39 and fixed to the rotary shaft 37. Each bracket 40 supports a roller 41. A pair of springs 42 are intervened between each movable stopper 39 and the associated bracket 40 to urge the movable stopper 39 toward the corresponding fixed stopper 36. To facilitate understanding, two brackets 40 are shown at different positions in FIG. 4. However, the brackets 40 are actually aligned with each other on the rotary shaft 37.

A locking cylinder 43 is provided for each bracket 40 on the main frame 23. Each cylinder 43 has a piston rod on which an actuator 44 is attached. The actuator 44 is engaged with the associated roller 41. When each cylinder 43 extends its piston rod with the shuttle holders 29 held on the platform 27, the associated movable stoppers 39 are moved to a position shown by the solid lines in FIG. 2. The movable stoppers 39 are pressed against the rear end 29*b* of the associated shuttle holders 29 by the force of springs 42 to prevent the shuttle holder 29 from moving toward the shuttle exchanging device 22.

An unlocking cylinder 45 is provided for each lever 38 on the main frame 23. Each cylinder 45 has a piston rod on which an actuator 46 is attached. The actuator 46 engages the lever 38. When the cylinder 45 extends its piston rod, the lever 38 is pivoted about the rotary shaft 37 such that the associated movable stopper 39 and bracket 40 are moved to the position shown by the dashed lines in FIG. 2. This separates the movable stopper 39 from the rear end 29*b* of the shuttle holder 29 and permits the movement of the shuttle holder 29 toward the shuttle exchanging device 22.

Figure 3:
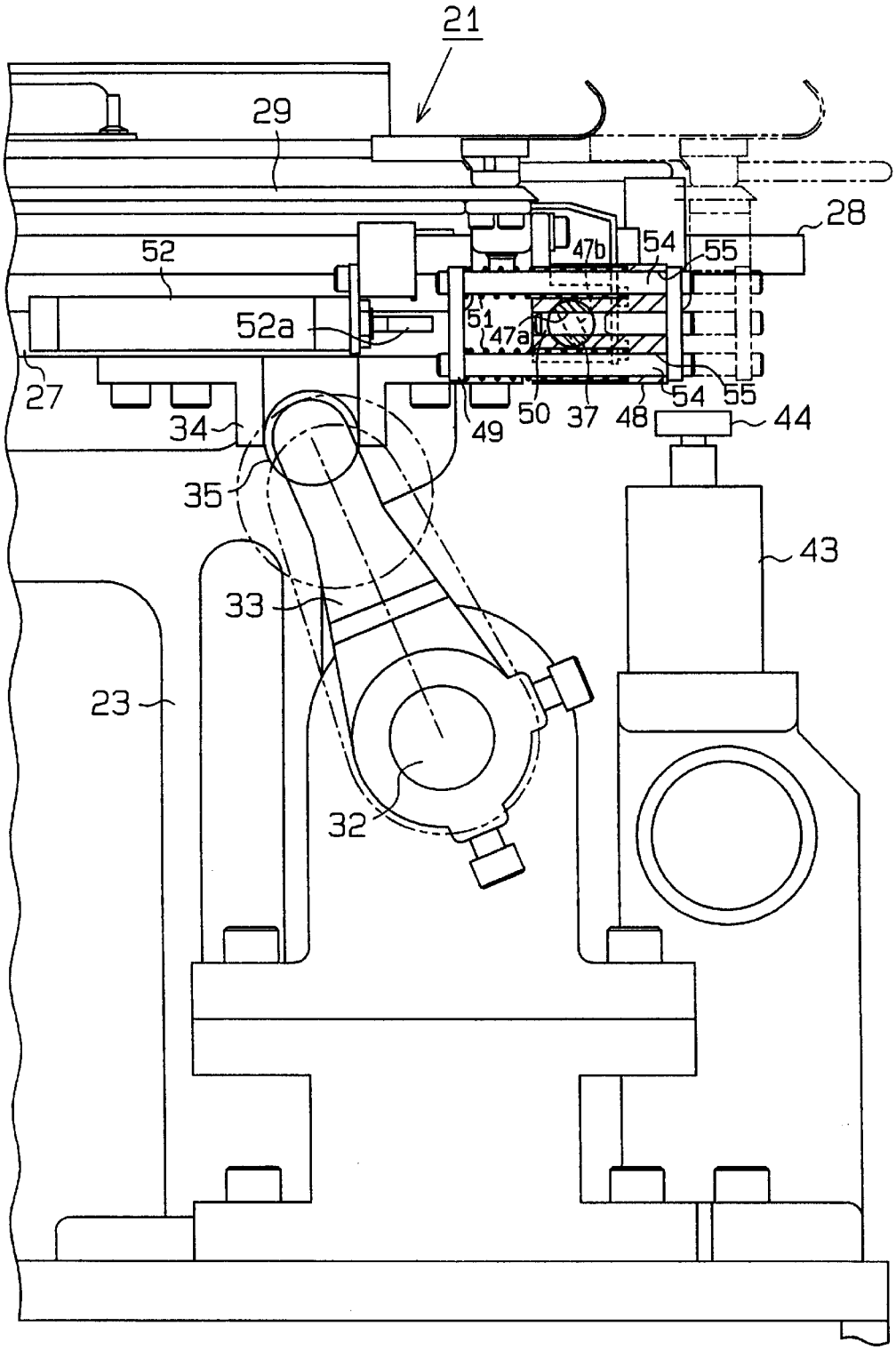
FIG. 3 is an enlarged cross-sectional view showing the sewing device.

As shown in FIGS. 3 and 4, a plurality of support blocks 48 are fixed to the platform 27. A bore 47*a* and a bore 47*b* are provided for each support block 48. Each set of bores 47*a*, 47*b* extends radially through the rotary shaft 37 in different directions at the same location. A movable frame 49 is movably supported by the support block 48 by means of guide rods 54 and guide bores 55. A pin 50, which engages and disengages the bore 47*a* or the bore 47*b*, extends through the middle of the movable frame 49.

A pair of springs 51 are arranged between each support block 48 and the associated movable frame to urge the movable frame 49 such that the pin 50 is inserted through the bore 47*a* or the bore 47*b*. A cylinder 52 is provided for each movable frame 49 on the platform 27 to disengage the pin 50 from the bore 47*a* or 47*b*. Each cylinder 52 has a piston rod 52*a* that engages the associated frame 49.

During normal sewing operation, the piston rod 52*a* of each cylinder 52 is retracted as shown by the solid line in FIG. 3. In this state, the associated pin 50 is moved into one of bores 47*a*, 47*b* by the force of the springs 51 to lock the rotary shaft 37. This restricts the rotation of the rotary shaft 37 and prevents the movable stoppers 39 from being moved to the position shown by the dashed lines in FIG. 2.

When all of or nearly all of thread wound on each bobbin is used, the associated shuttle 31 must be replaced with a new shuttle 31. In such case, the cylinders 52 project their piston rods 52*a* to move the movable frames 49 against the force of the springs 51. This moves the pins 50 out of the bore 47*a* or the bore 47*b* and unlocks the rotary shaft 37. As a result, the movable stoppers 39 can be pivoted to the position shown by the dashed lines in FIG. 2.

The structure of the shuttle exchanging device 22 will now be described with reference to FIGS. 1, 5, 6, and 7.

The shuttle exchanging device 22 is located adjacent to the sewing device 21 and employed to replace shuttles 31 holding empty bobbins with shuttles 31 holding full bobbins. The shuttle exchanging device 22 includes a frame 56, which is secured to the rear portion of the sewing device 21, a transfer mechanism 57 for transferring the shuttle holders 29, a discharge mechanism 58 for discharging the shuttles 31 holding empty bobbins, and a supply mechanism 59 for supplying shuttles 31 holding full bobbins.

The transfer mechanism 57 transfers shuttle holders 29 supporting shuttles 31 between a sewing position, which is located in correspondence with the sewing device 21, and a shuttle exchange position, which is separated rearward from the sewing device 21. The discharge mechanism 58 discharges shuttles 31 holding empty bobbins from the shuttle holders 29 at the shuttle exchange position. The supply mechanism 59 supplies shuttles 31 holding full bobbins to the shuttle holders 29 at the shuttle exchange position.

A pivotal platform 61 is pivotally supported by a rotary shaft 62 for each shuttle holder 29 in the discharge mechanism 58. A pair of guide rails 63 extend along the pivotal platform 61. A transfer plate 64 is movably supported between the guide rails 63. A pair of hooks 65 are pivotally supported by a pivot pin 66 on the transfer plate 64. Each hook 65 engages a key 67 located at the rear end of the shuttle holder 29.

Figure 5:
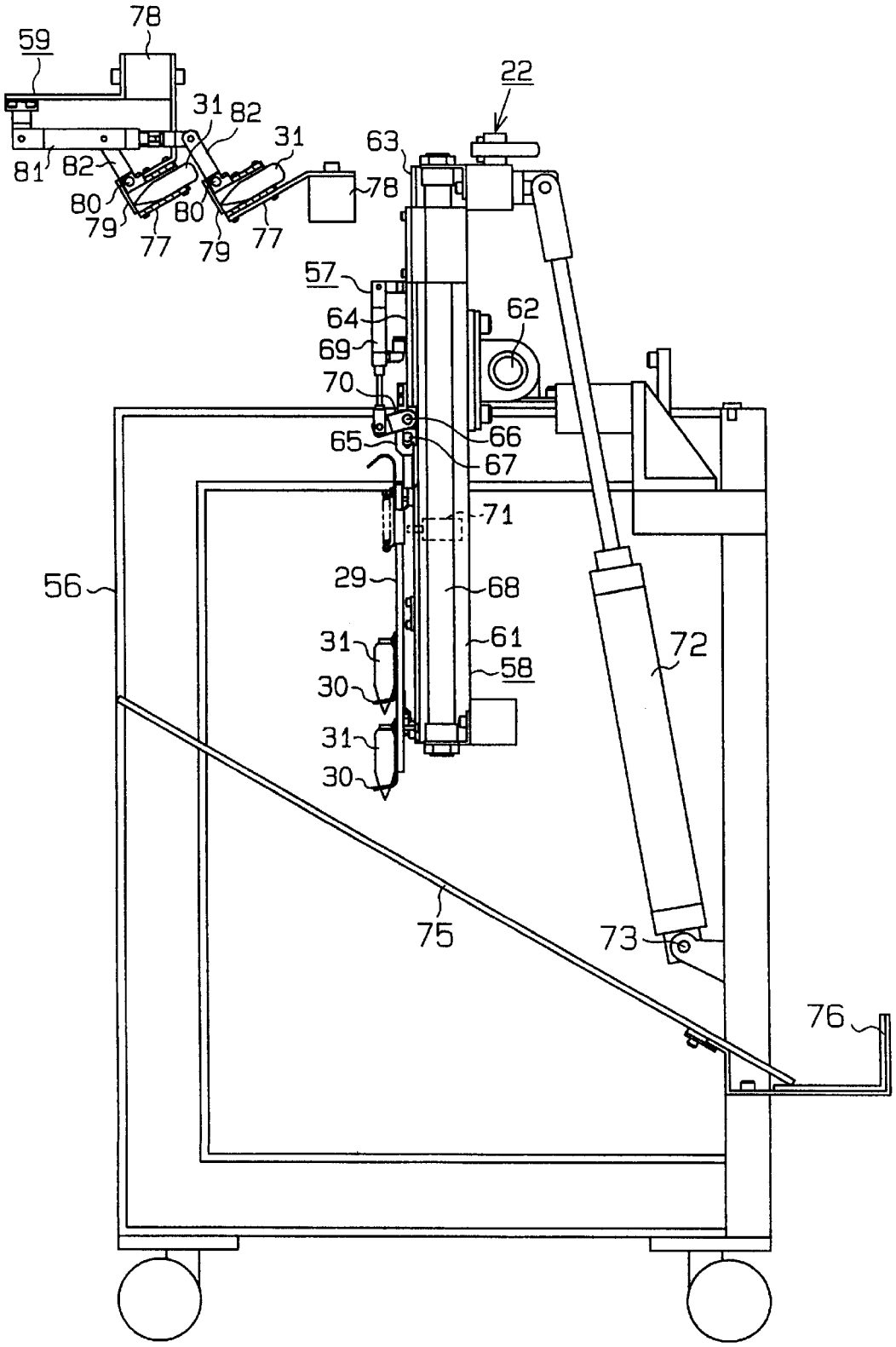
FIG. 5 is an enlarged side view showing a shuttle exchanging device employed in the sewing machine.

A rodless transfer cylinder 68 having a piston connected to the transfer plate 64 is arranged under the pivotal platform 61, as viewed in FIG. 5. The rodless transfer cylinder 68 drives the transfer plate 64 such that each hook 65 is moved between the sewing position shown in FIG. 8 and the shuttle exchange position shown in FIG. 7.

A hooking cylinder 69 is arranged on the transfer plate 64. The cylinder 69 has a piston rod that is pivotally connected with the pivot pin 66 by a connecting lever 70.

Figure 8:
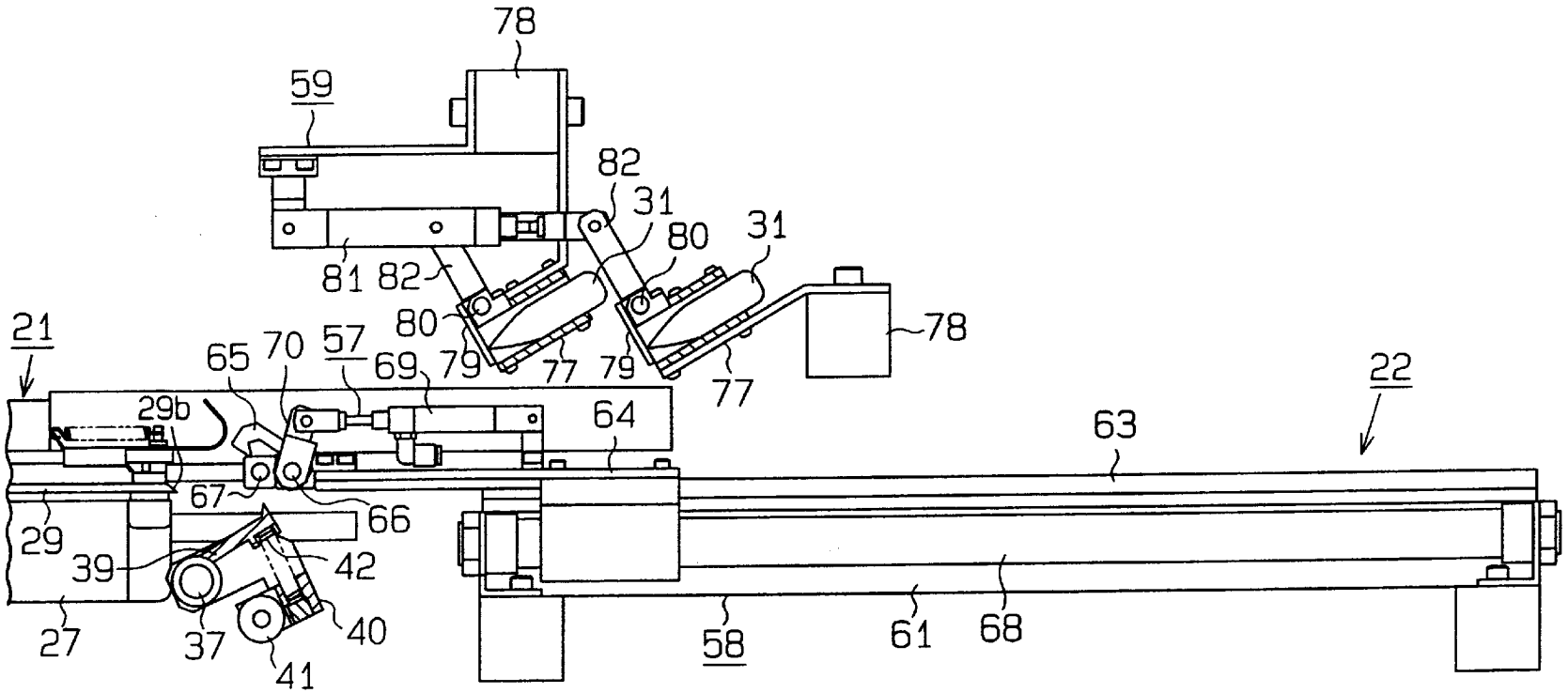
FIG. 8 is a side view showing the operational procedure taken by the shuttle exchanging device subsequent to the procedure shown in FIG. 7.

When the hooks 65 and the transfer plate 64 are located at the sewing position shown in FIG. 8, projection of the piston rod from the cylinder 69 engages the hooks 65 with the key 67 by means of the lever 70 and the pivot pin 66. In the same state, the retraction of the piston rod into the cylinder 69 pivots and separates the hooks 65 from the key 67.

Furthermore, the hooks 65 engaged with the key 67 and the transfer plate 64 are moved from the sewing position to the shuttle exchange position by the cylinder 68. This causes the shuttle holders 29 supporting shuttles 31 to move from the sewing position on the platform 27 to the shuttle exchange position on the platform 61, as viewed in FIGS. 5 and 9.

Figure 6:
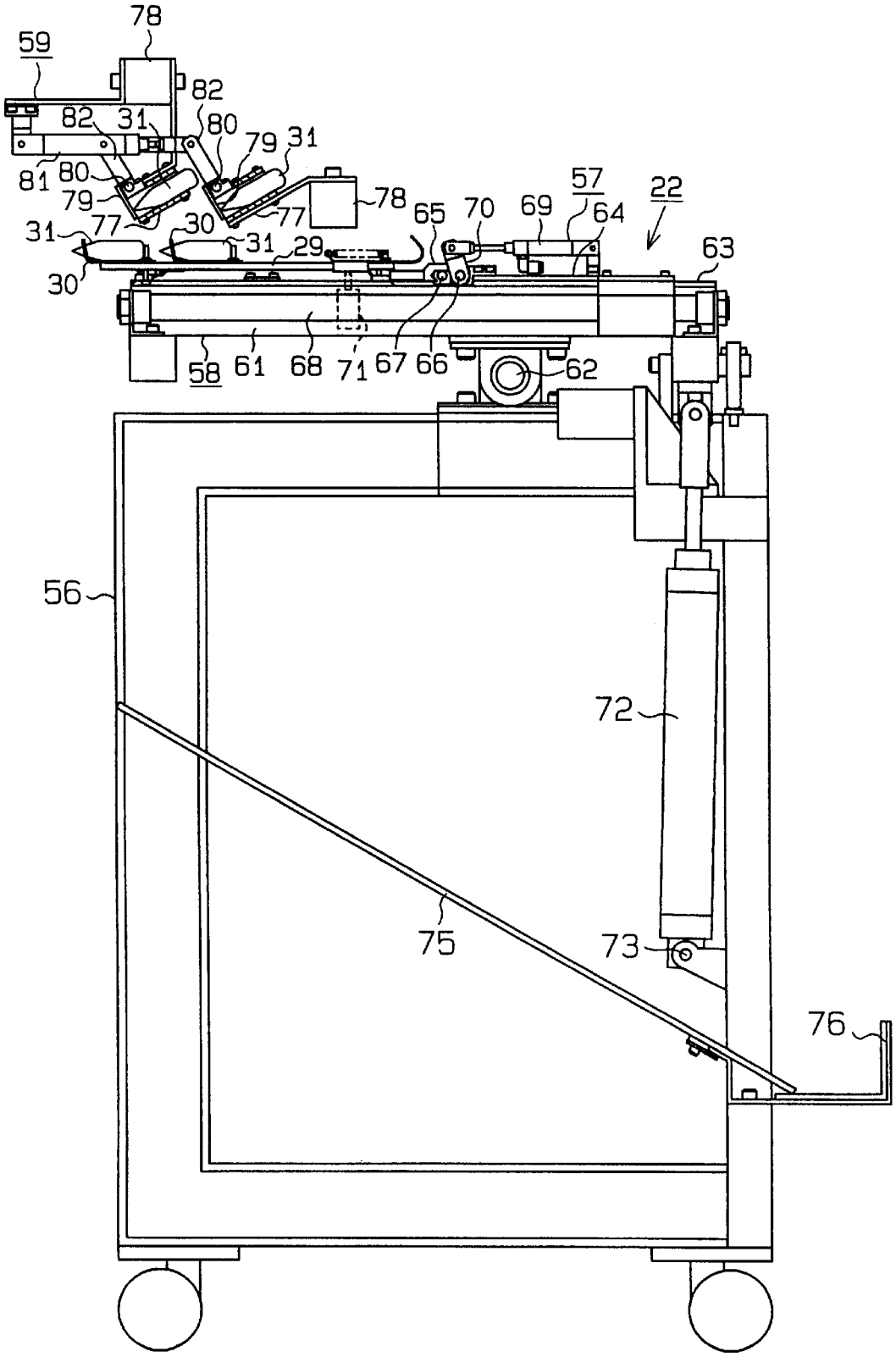
FIG. 6 is a side view showing the operation of the shuttle exchanging device.

As shown in FIGS. 5 and 6, the platform 61 includes a stopper cylinder 71. When the shuttle holders 29 are located at the shuttle exchange position on the platform 61, the stopper cylinder 71 is projected to engage part of the shuttle holders 29. As a result, the shuttle holders 29 are locked to the platform 61.

The discharge mechanism 58 includes a pivoting cylinder 72, which is pivotally supported about a pivot pin 73 on the frame 56. The pivoting cylinder 72 has a piston rod, which is connected to the rear end of the platform 61. When the shuttle holders 29 are located at the shuttle exchange position on the platform 61, projection of the piston rod from the cylinder 72 pivots the platform 61 from a horizontal position to a vertical position, as viewed in FIGS. 6 and 10. Shuttles 31 holding empty bobbins fall off the shuttle holders 29 when the platform 61 is located at the vertical position.

Figure 10:
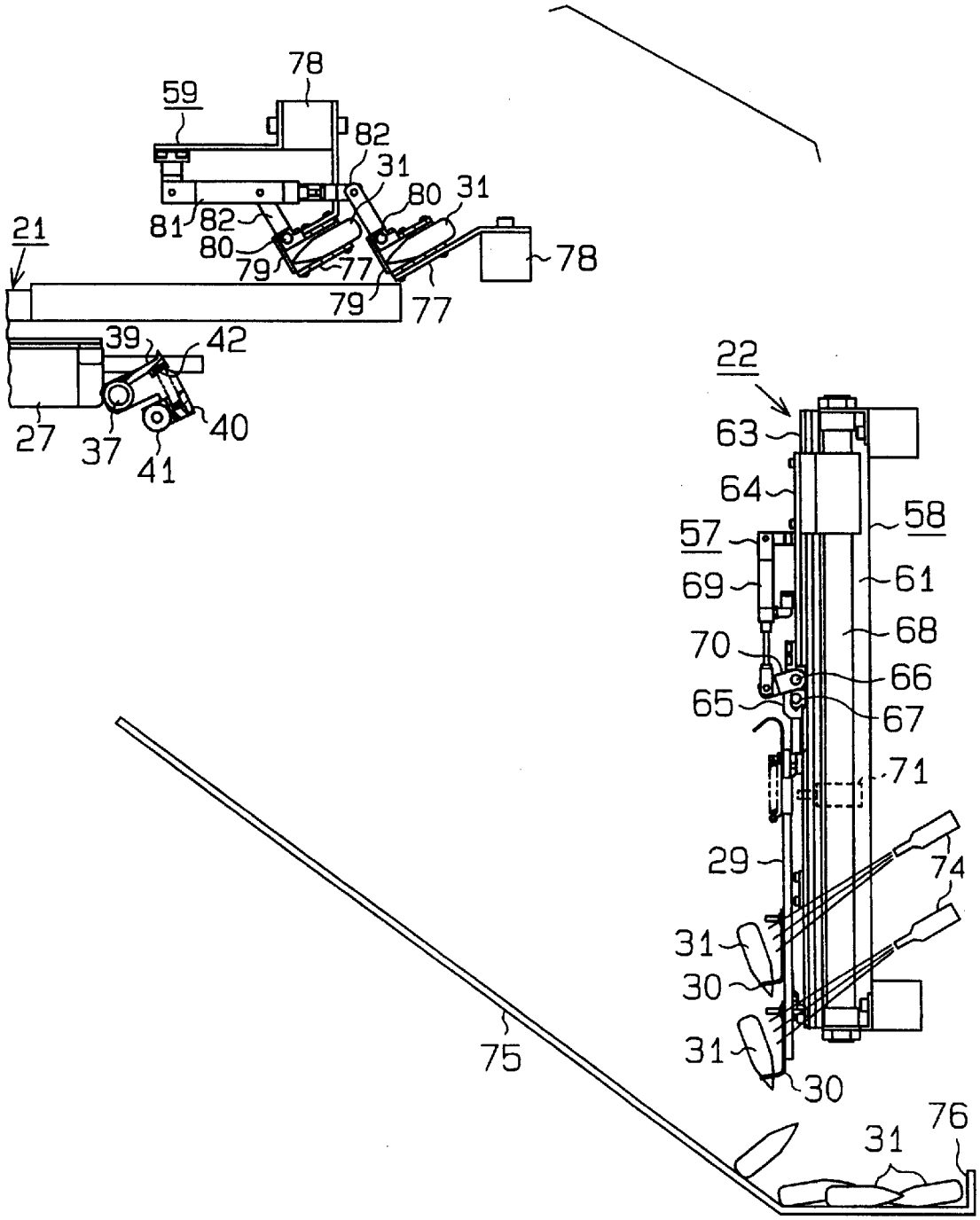
FIG. 10 is a side view showing the operational procedure taken by the shuttle exchanging device subsequent to the procedure shown in FIG. 9.

As shown in FIG. 10, air nozzles 74 are arranged under the platform 61 in correspondence with the shuttles 31 held on the shuttle holders 29. When the platform 61 supporting the shuttle holders 29 is pivoted to the vertical position, compressed air is blasted toward the shuttles 31 from the air nozzles 74. This aids the removal of the shuttles 31 from the shuttle holders 29.

As shown in FIGS. 1, 5, 6, and 10, a shuttle chute 75, which extends obliquely, is arranged at the lower portion of the frame 56. A retriever 76 is defined at the lowest portion of the shuttle chute 75 to receive the shuttles 31 that fall off the shuttle holders 29 and slide down the chute 75.

Figure 11:
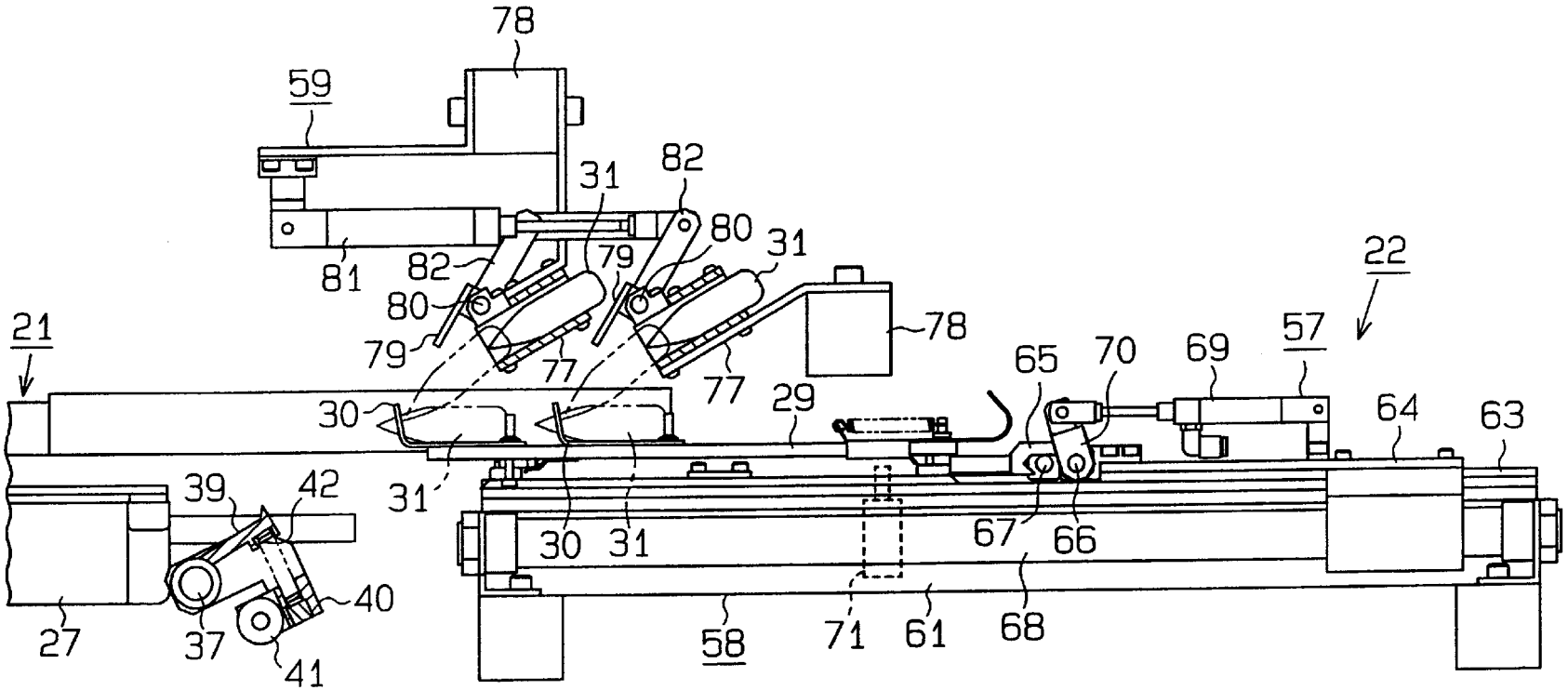
FIG. 11 is a side view showing the operational procedure taken by the shuttle exchanging device subsequent to the procedure shown in FIG. 10.
Figure 12:
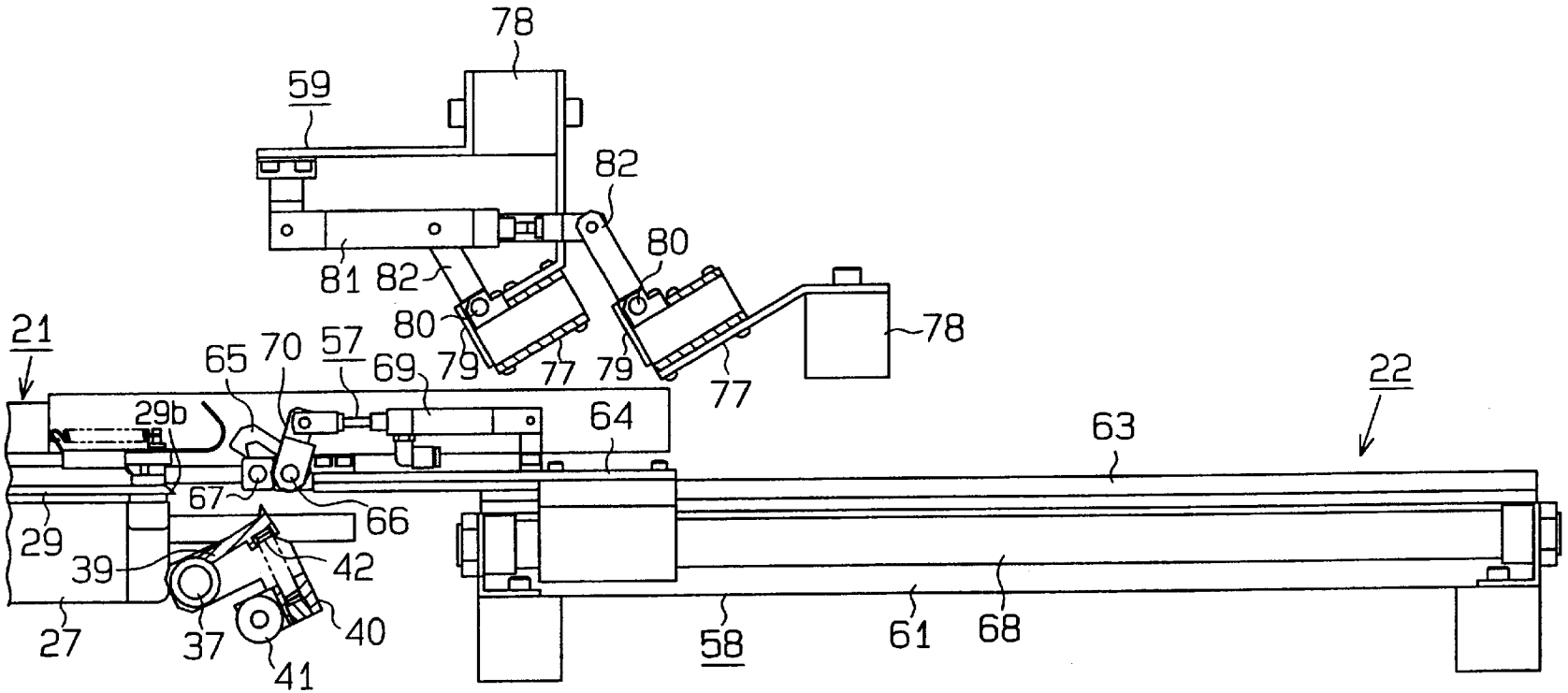
FIG. 12 is a side view showing the operational procedure taken by the shuttle exchanging device subsequent to the procedure shown in FIG. 11.

As shown in FIGS. 1, 5, and 11, the supply mechanism 59 includes a plurality of tubular shuttle retainers 77 that are held obliquely by a feeder 78 located above the frame 56. When the shuttle holders 29 are moved to the shuttle exchange position, the tubular shuttle retainers 77 are arranged in correspondence with the shuttle carriers 30. Each shuttle retainer 77 has a lid 79 that is pivotally supported about a pivot pin 80 at the lowest end of the shuttle retainer 77. The lid 79 selectively opens and closes lower ends of the shuttle retainers 77. The feeder 78 includes a feeder cylinder 81. The cylinder 81 has a piston rod that is connected to the lids 79 by connecting levers 82.

Figure 7:
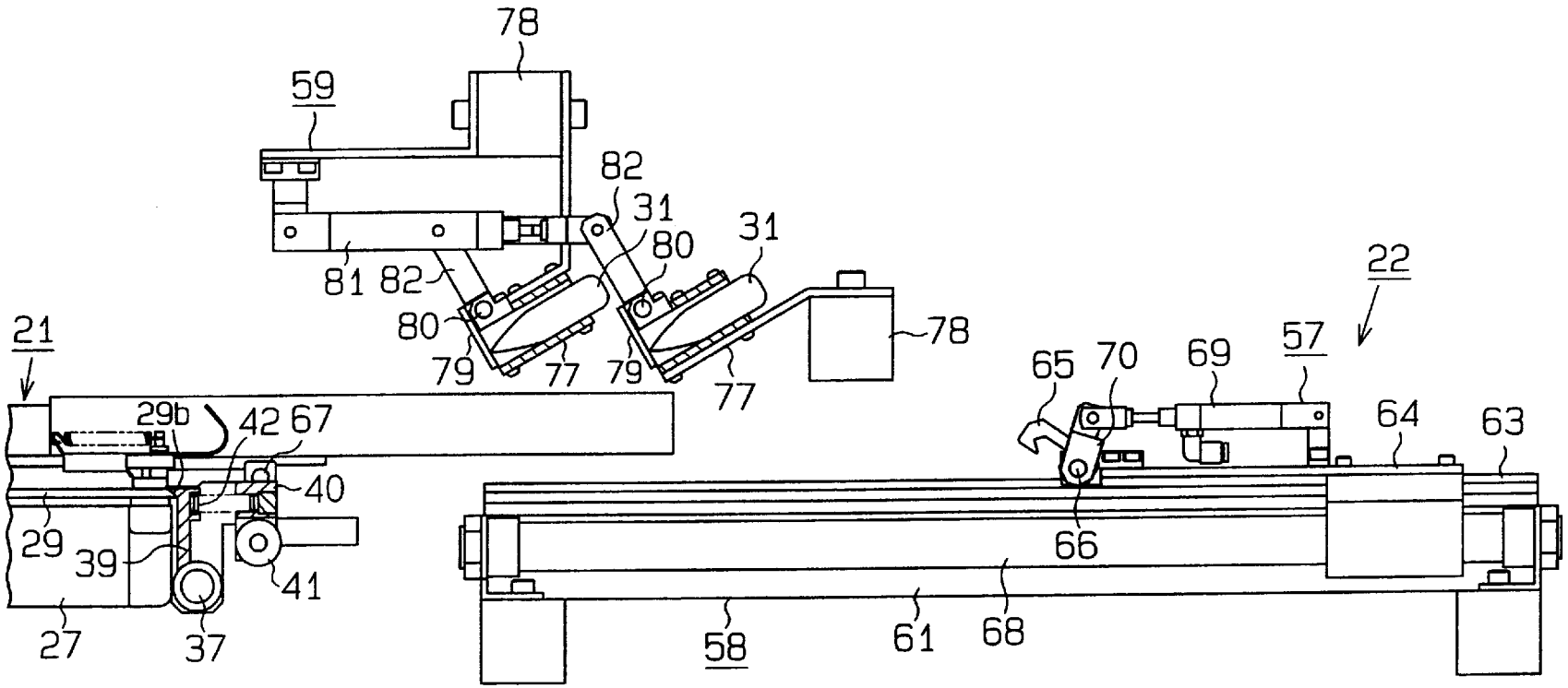
FIG. 7 is a side view showing an operating procedure taken by the shuttle exchanging device.

As shown in FIGS. 5 and 7, the piston rod of the cylinder 81 is normally retracted. Thus, the lower ends of the shuttle retainers 77 are normally closed by the lids 79. A shuttle 31 holding a full bobbin is retained in each shuttle retainer 77 above the associated shuttle carrier 30.

After shuttles 31 holding empty bobbins are discharged from the shuttle holders 29 by the shuttle discharge mechanism 58, the piston rod of the cylinder 81 is projected to pivot each lid 79 and open the lower end of the associated shuttle retainers 77 by means of the connecting lever 82, as shown in FIG. 11. This causes the retained shuttle 31, which holds a full bobbin, to fall onto the associated shuttle carrier 30.

The operation of the sewing machine will now be described with reference to FIGS. 7–12.

As shown in FIGS. 1, 2, and 7, when the sewing machine performs the sewing operation, the shuttle holders 29 supporting shuttles 31 are located at the sewing position on the movable platform 27 of the sewing device 21. The front end 29*a* of each shuttle holder 29 is engaged with the associated fixed stoppers 36 and the rear end 29*b* of each holder 29 is engaged with the associated movable stoppers 39. Thus, each shuttle holder 29 is fixed at its predetermined position on the movable platform 27.

In this state, each needle 26 is reciprocated vertically to pierce the fabric web 25. Simultaneously, the lever 33 is reciprocally pivoted by the drive shaft 32 between the positions shown by the solid lines and the dashed lines in FIGS. 1 and 2. This moves the shuttle holders 29, which is supported on the movable platform 27, back and forth in a direction perpendicular to the axes of the needles 26. The cooperative motion of the needle 26 and the associated shuttle 31 forms stitching patterns on the fabric web 25 with the upper thread supplied to the needle 26 and the lower thread from the bobbin held in the shuttle 31.

When the bobbins become empty or nearly empty, the shuttles 31 holding such bobbins are replaced by shuttles 31 holding full bobbins. To replace the shuttles 31, the piston rod 52*a* of each cylinder 52 is projected from the position shown in FIG. 3. This moves the associated movable frame 49 against the force of the springs 51. As a result, the pin 50 is disengaged from the bore 47*a* thereby unlocking the rotary shaft 37.

The actuator 46 of each unlocking cylinder 45 is projected from the position to rotate the rotary shaft 37 with the associated lever 38. This pivots the movable stoppers 39 and the brackets 40 from the position shown by the solid lines in FIG. 2 to the position shown by the dashed lines in FIG. 2. As a result, each movable stopper 39 is moved away from the rear end 29*b* of the associated shuttle holder 29, thus freeing the rear side of the shuttle holder. The piston rod 52*a* of each cylinder 52 is then retracted to insert the pin 50 into the other bore 47*b* using the force of the springs 51. This locks the rotary shaft 37. Afterward, the rodless transfer cylinder 68 of the transfer mechanism 57 employed by the shuttle exchanging device 22 moves the transfer plate 64 toward the sewing device 21 along the guide rail 63 of the pivotal platform 61. This moves the hooks 65 from the exchange position shown in FIG. 7 to the sewing position shown in FIG. 8. In this state, the piston rod of the hooking cylinder 69 is projected to pivot the hooks 65 counterclockwise by means of the connecting lever 70 and the pivot pin 66. This engages the hooks 65 to the key 67 located at the rear end of the associated shuttle holder 29.

Figure 9:
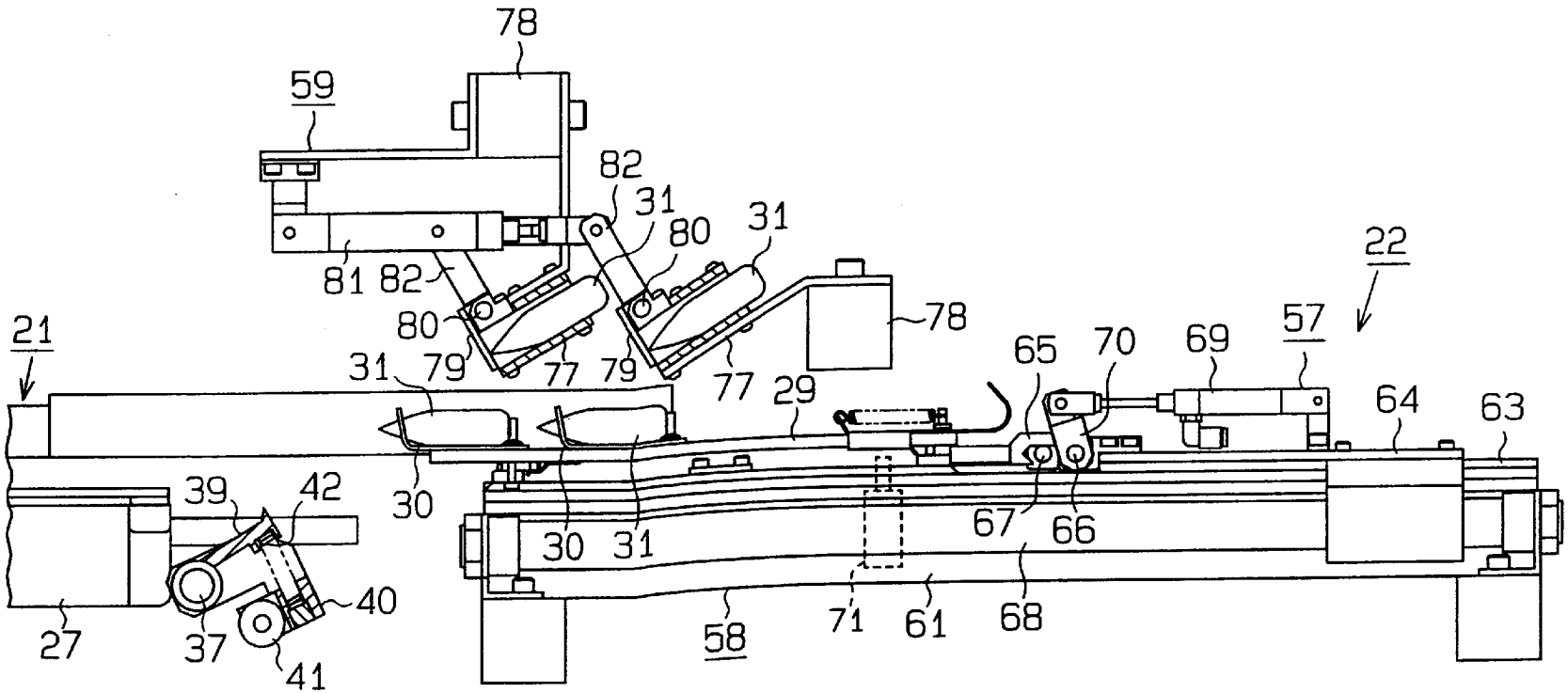
FIG. 9 is a side view showing the operational procedure taken by the shuttle exchanging device subsequent to the procedure shown in FIG. 8.

Subsequently, the rodless transfer cylinder 68 moves the transfer plate 64 away from the sewing device 21 and returns the hooks 65 to the exchange position. As shown in FIG. 9, this moves the shuttle holder 29 supporting the shuttles 31 holding empty bobbins from the sewing position on the movable platform 27 to the shuttle exchange position on the pivotal platform 61 of the shuttle exchanging device 22. In this state, the stopper cylinder 71 fixes the shuttle holder 29 to the pivotal platform 61.

The piston rod of the pivoting cylinder 72 of the discharge mechanism 58 is projected to pivot the pivotal platform 61 and the shuttle holder 29 from the horizontal position shown in FIG. 9 to the vertical position shown in FIG. 10. This causes the shuttles 31 holding empty bobbins to fall off the shuttle holder 29. Compressed air is also blasted against each shuttle 31 from the air nozzles 74 to aid the removal of the shuttles 31 from the shuttle holder 29. The shuttles 31 then slide down the chute 75 and are retrieved by the shuttle retriever 76.

The piston rod of the pivoting cylinder 72 is then retracted to return the pivotal platform 61 and the shuttle holder 29 to the original horizontal position as shown in FIG. 11. In this state, the piston rod of the cylinder 81 of the supply mechanism 59 is projected to pivot each lid 79 and open the lower end of each shuttle retainer 77. This places shuttles 31 holding full bobbins onto the associated shuttle carrier 30.

After feeding the shuttles 31, the stopper cylinder 71 frees the shuttle holder 29. The rodless transfer cylinder 68 then moves the transfer plate 64 to the sewing device 21. The hooks 65 are pivoted from the shuttle exchange position shown in FIG. 11 to the sewing position shown in FIG. 12. Consequently, the shuttle holder 29, which supports shuttles 31 holding full bobbins, is transferred from the shuttle exchange position located on the pivotal platform 61 of the shuttle exchanging device 22 to the sewing position located on the movable platform 27 of the sewing device 21. The piston rod of the hooking cylinder 69 is then retracted to remove the hooks 65 from the key 67 at the rear end of the associated shuttle holder 29.

Subsequently, the pin 50 is removed from the bore 47*b* by the cylinder 52 to unlock the rotary shaft 37. In this state, the locking cylinders 43 pivot the movable stoppers 39 to the position shown by the solid lines in FIG. 2 by means of the bracket 40. The movable stoppers 39 are pressed against the rear end 29*b* of the shuttle holder 29 by the force of the springs 42. This restricts movement of the rear end of the shuttle holder 29. In this state, the fixed stoppers 36 are engaged with the front end 29*a* of the shuttle holder 29 thus restricting movement of the front end of the shuttle holder 29. Each cylinder 52 then retracts its piston rod to move the associated movable frame 49 with the force of the springs 51 so that the pin 50 is inserted into the bore 47*a*. This locks the rotary shaft 37.

The cooperative motion of the transfer mechanism 57 of the shuttle exchanging device 22, the shuttle discharge mechanism 58, and the supply mechanism 59 automatically replaces shuttles 31 holding empty bobbins with the shuttles 31 holding full bobbins. Therefore, replacement of the shuttles 31 is performed within a short period of time. Accordingly, the sewing machine quickly commences the sewing operation.

The preferred and illustrated embodiment obtains the following advantages.

The shuttle exchanging device 22 is employed to replace shuttles 31 holding lower thread bobbins. Thus, when the bobbins become empty or nearly empty, the bobbins are automatically replaced with shuttles 31 holding full bobbins. This enhances the sewing efficiency.

The shuttle exchanging device 22 includes the transfer mechanism 57, which transfers the shuttle holders 29 between the sewing position and the shuttle exchange position. The discharge mechanism 58 discharges shuttles 31 holding empty bobbins from the shuttle holders 29 at the discharge position. The shuttle supply mechanism 59 supplies shuttles 31 holding full bobbins to the shuttle holders 29 at the shuttle exchange position. Accordingly, the shuttle exchanging device 22, which structure is simple, guarantees the replacement of shuttles 31 holding empty bobbins with shuttles 31 holding full bobbins.

The shuttle transfer mechanism 57 employs the hooks 65, which engage the key 67 of the associated shuttle holder 29. The rodless transfer cylinder 68 moves the hooks 65 between the sewing position and the shuttle exchange position. Accordingly, the transfer mechanism 57 moves the shuttle holders 29 between the sewing position and the shuttle exchange position with a simple structure.

The discharge mechanism 58 employs the pivotal platform 61, which supports the shuttle holders 29 at the shuttle exchange position, and the pivoting cylinder 72, which pivots the platform 61 between the horizontal position and the vertical position. Accordingly, the discharge mechanism 58 discharges shuttles 31 holding empty bobbins from the shuttle holders 29 with a simple structure.

The supply mechanism 59 employs the shuttle retainers 77, which retain shuttles 31 holding full bobbins above the shuttle holders 29 at the shuttle exchange position, and the cylinder 81, which removes shuttles 31 from the shuttle retainers 77 onto the shuttle holders 29. This structure guarantees the supply of shuttles 31 holding full bobbins to the shuttle holders 29.

It should be apparent to those skilled in the art that the present invention may be embodied in may other specific forms without departing from the spirit of scope of the invention. Particularly, it should be understood that the present invention may be embodied in the following forms.

A conveyor may be connected to the shuttle retriever 76 in the discharge mechanism 58 so that shuttles 31 holding empty bobbins may automatically be transferred to a designated location.

A shuttle replenishing mechanism may be arranged above the shuttle retainers 77 in the supply mechanism 59 to automatically replenish the retainers 77.

Therefore, the present examples and embodiments are to be considered as illustrative and not restrictive and the invention is not to be limited to the details given herein, but may be modified within the scope and equivalence of the appended claims.

What is claimed is:

1. A sewing machine for forming stitch patterns on a fabric web, comprising:

a plurality of needles reciprocally movable in a first direction through the fabric web;

shuttles reciprocally movable between a first position and a second position in a second direction perpendicular to the first direction, wherein said shuttles cooperate with the needles to form the stitch patterns on the fabric web;

bobbins respectively accommodated in the shuttles, wherein each of said bobbins is full of a thread when the associated shuttle is in the first position, wherein each bobbin is empty of the thread when the associated shuttle is in the second position; and a device for automatically replacing the shuttle accommodating the empty bobbin in the second position with the shuttle accommodating the full bobbin in the first position.

2. The sewing machine as set forth in claim 1, further comprising a shuttle holder for holding the shuttle and a first mechanism for transferring the shuttle holder between the first position and the second position.

3. The sewing machine as set forth in claim 2, further comprising a second mechanism for discharging the shuttle from the shuttle holder that has been transferred to the second position.

4. The sewing machine as set forth in claim 3, further comprising a third mechanism for supplying the new shuttle to the shuttle holder positioned in the replacing position.

5. The sewing machine as set forth in claim 4, wherein said first mechanism includes an engaging member selectively engagable and disengagable with the shuttle holder and a driving member for driving the engaging member between the first position and the second position.

6. The sewing machine as set forth in claim 4, wherein said second mechanism includes a support member for supporting the shuttle holder in the replacing position, a rotating member for rotating the support member between a horizontal position and a vertical position and receiving member for receiving the bobbin discharged from the shuttle holder.

7. The sewing machine as set forth in claim 4, wherein said third mechanism includes a retaining member for retaining the shuttle above the shuttle holder in the replacing position and a feeding member for feeding the shuttle to the shuttle holder from the retaining member.

8. The sewing machine as set forth in claim 1, wherein said replacing device is positioned in a frame attached to a main frame of the sewing machine.

9. The sewing machine as set forth in claim 1, further comprising a locking mechanism for holding the shuttle holder in the first position.

10. The sewing machine as set forth in claim 9, wherein said locking mechanism is positioned in the main frame.

11. A sewing machine for forming stitch patterns on a fabric web, comprising:

a plurality of needles reciprocally movable in a first direction through the fabric web;

shuttles reciprocally movable between a first position and a second position in a second direction perpendicular to the first direction, wherein said shuttles cooperate with the needles to form the stitch patterns on the fabric web;

bobbins respectively accommodated in the shuttles, wherein each of said bobbins is full of a thread when the associated shuttle is in the first position, wherein each bobbin is empty of the thread when the associated shuttle is in the second position;

a shuttle holder for holding the shuttle;

a first mechanism for transferring the shuttle holder between the first position and the second position;

a second mechanism for discharging the shuttle from the shuttle holder that has been transferred to the second position; and a third mechanism for supplying the new shuttle to the shuttle holder positioned in the replacing position.

12. The sewing machine as set forth in claim 11, wherein said first mechanism includes an engaging member selectively engagable and disengagable with the shuttle holder and a driving member for driving the engaging member between the first position and the second position.

13. The sewing machine as set forth in claim 11, wherein said second mechanism includes a support member for supporting the shuttle holder in the replacing position, a rotating member for rotating the support member between a horizontal position and a vertical position and receiving member for receiving the bobbin discharged from the shuttle holder.

14. The sewing machine as set forth in claim 13, wherein said third mechanism includes a retaining member for retaining the shuttle above the shuttle holder in the replacing position and a feeding member for feeding the shuttle to the shuttle holder from the retaining member.

15. The sewing machine as set forth in claim 11, wherein said replacing device is positioned in a frame attached to a main frame of the sewing machine.

16. The sewing machine as set forth in claim 11, further comprising a locking mechanism for holding the shuttle holder in the first position.

17. The sewing machine as set forth in claim 16, wherein said locking mechanism is positioned in the main frame.

* * * * *